US006443428B1

(12) United States Patent
Santibanez et al.

(10) Patent No.: US 6,443,428 B1
(45) Date of Patent: Sep. 3, 2002

(54) NAIL REMOVING APPARATUS

(76) Inventors: Florentino Santibanez, 14414 Merry Meadow Dr., Houston, TX (US) 77049-4318; Maria C. Santibanez, 14414 Merry Meadow Dr., Houston, TX (US) 77049-4318

( * ) Notice: Subject to any disclaimer, the term of this patent is extended or adjusted under 35 U.S.C. 154(b) by 0 days.

(21) Appl. No.: 09/849,433

(22) Filed: May 4, 2001

(51) Int. Cl.[7] ..... B25C 11/00
(52) U.S. Cl. ..... 254/18; 254/95
(58) Field of Search ..... 254/18, 95, 28, 254/19, 30, 29 R; 29/239, 237, 252

(56) References Cited

U.S. PATENT DOCUMENTS

| | | | | | |
|---|---|---|---|---|---|
| 919,370 | A | | 4/1909 | Lund | |
| 1,188,380 | A | | 6/1916 | Arthur | |
| 1,317,156 | A | | 9/1919 | Diamond | |
| 2,330,874 | A | | 10/1943 | Eaves | |
| 2,706,103 | A | * | 4/1955 | Stambaugh et al. | 254/18 |
| 3,704,860 | A | * | 12/1972 | Krapu | 254/95 |
| 3,814,382 | A | * | 6/1974 | Castoe | 254/18 |
| 3,978,576 | A | * | 9/1976 | Mustoe, Jr. | 254/18 |
| 4,078,766 | A | | 3/1978 | Saurwein | |
| D336,026 | S | | 6/1993 | Fujiwara | |
| 5,653,424 | A | * | 8/1997 | Khan | 254/28 |

* cited by examiner

*Primary Examiner*—Lee Wilson

(57) ABSTRACT

A nail removing apparatus for removing and holding nails. The nail removing apparatus includes a housing having a bottom wall, a front wall, a back wall, a pair of side walls and a top wall. The bottom wall has an opening therein extending into the interior. A foot portion is integrally coupled to the bottom wall and includes a pair of tines adapted for positioning under a head of the nail. A lifting apparatus lifts a nail and includes a saddle positioned in the housing. A first plate is slidably mounted on the saddle and is extendable through the opening in the bottom wall. A second plate is integrally coupled to a bottom edge of the first plate and has a pair of prongs thereon for lifting a nail from the foot portion. A motor is mechanically coupled to the first plate for selectively retracting and extending the first plate.

9 Claims, 5 Drawing Sheets

NAIL REMOVING APPARATUS

BACKGROUND OF THE INVENTION

1. Field of the Invention

The present invention relates to nail removing devices and more particularly pertains to a new nail removing apparatus for removing and holding nails.

2. Description of the Prior Art

The use of nail removing devices is known in the prior art. More specifically, nail removing devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 1,188,380; U.S. Pat. No. 4,078,766; U.S. Pat. No. 1,317,156; U.S. Pat. No. 2,330,874; U.S. Des. Pat. No. 336,026; and U.S. Pat. No. 919,370.

While these devices fulfill their respective, particular objectives and requirements, the aforementioned patents do not disclose a new nail removing apparatus. The inventive device includes a housing having a bottom wall, a front wall, a back wall, a pair of side walls and a top wall. The bottom wall has an opening therein extending into the interior. A handle is coupled to an outer surface of the back wall. A foot portion is integrally coupled to the bottom wall and includes a pair of tines adapted for positioning under a head of the nail. A lifting apparatus lifts a nail and includes a saddle positioned in the housing. A first plate is slidably mounted on the saddle and is extendable through the opening in the bottom wall. A second plate is integrally coupled to a bottom edge of the first plate and has a pair of prongs thereon for lifting a nail from the foot portion. A motor is mechanically coupled to the first plate for selectively retracting and extending the first plate.

In these respects, the nail removing apparatus according to the present invention substantially departs from the conventional concepts and designs of the prior art, and in so doing provides an apparatus primarily developed for the purpose of removing and holding nails.

SUMMARY OF THE INVENTION

In view of the foregoing disadvantages inherent in the known types of nail removing devices now present in the prior art, the present invention provides a new nail removing apparatus construction wherein the same can be utilized for removing and holding nails.

The general purpose of the present invention, which will be described subsequently in greater detail, is to provide a new nail removing apparatus apparatus and method which has many of the advantages of the nail removing devices mentioned heretofore and many novel features that result in a new nail removing apparatus which is not anticipated, rendered obvious, suggested, or even implied by any of the prior art nail removing devices, either alone or in any combination thereof.

To attain this, the present invention generally comprises a housing having a bottom wall, a front wall, a back wall, a pair of side walls and a top wall. The bottom wall has an opening therein extending into the interior. A handle is coupled to an outer surface of the back wall. A foot portion is integrally coupled to the bottom wall and includes a pair of tines adapted for positioning under a head of the nail. A lifting apparatus lifts a nail and includes a saddle positioned in the housing. A first plate is slidably mounted on the saddle and is extendable through the opening in the bottom wall. A second plate is integrally coupled to a bottom edge of the first plate and has a pair of prongs thereon for lifting a nail from the foot portion. A motor is mechanically coupled to the first plate for selectively retracting and extending the first plate.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new nail removing apparatus apparatus and method which has many of the advantages of the nail removing devices mentioned heretofore and many novel features that result in a new nail removing apparatus which is not anticipated, rendered obvious, suggested, or even implied by any of the prior art nail removing devices, either alone or in any combination thereof.

It is another object of the present invention to provide a new nail removing apparatus which may be easily and efficiently manufactured and marketed.

It is a further object of the present invention to provide a new nail removing apparatus which is of a durable and reliable construction.

An even further object of the present invention is to provide a a new nail removing apparatus which is susceptible of a low cost of manufacture with regard to both materials and labor, and which accordingly is then susceptible of low prices of sale to the consuming public, thereby making such nail removing apparatus economically available to the buying public.

Still yet another object of the present invention is to provide a new nail removing apparatus which provides in the apparatuses and methods of the prior art some of the advantages thereof, while simultaneously overcoming some of the disadvantages normally associated therewith.

Still another object of the present invention is to provide a new nail removing apparatus for removing and holding nails.

Yet another object of the present invention is to provide a new nail removing apparatus which includes a housing having a bottom wall, a front wall, a back wall, a pair of side walls and a top wall. The bottom wall has an opening therein extending into the interior. A handle is coupled to an outer surface of the back wall. A foot portion is integrally coupled to the bottom wall and includes a pair of tines adapted for positioning under a head of the nail. A lifting apparatus lifts a nail and includes a saddle positioned in the housing. A first plate is slidably mounted on the saddle and is extendable through the opening in the bottom wall. A second plate is integrally coupled to a bottom edge of the first plate and has a pair of prongs thereon for lifting a nail from the foot portion. A motor is mechanically coupled to the first plate for selectively retracting and extending the first plate.

Still yet another object of the present invention is to provide a new nail removing apparatus that holds a plurality of nails for later use or recycling.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
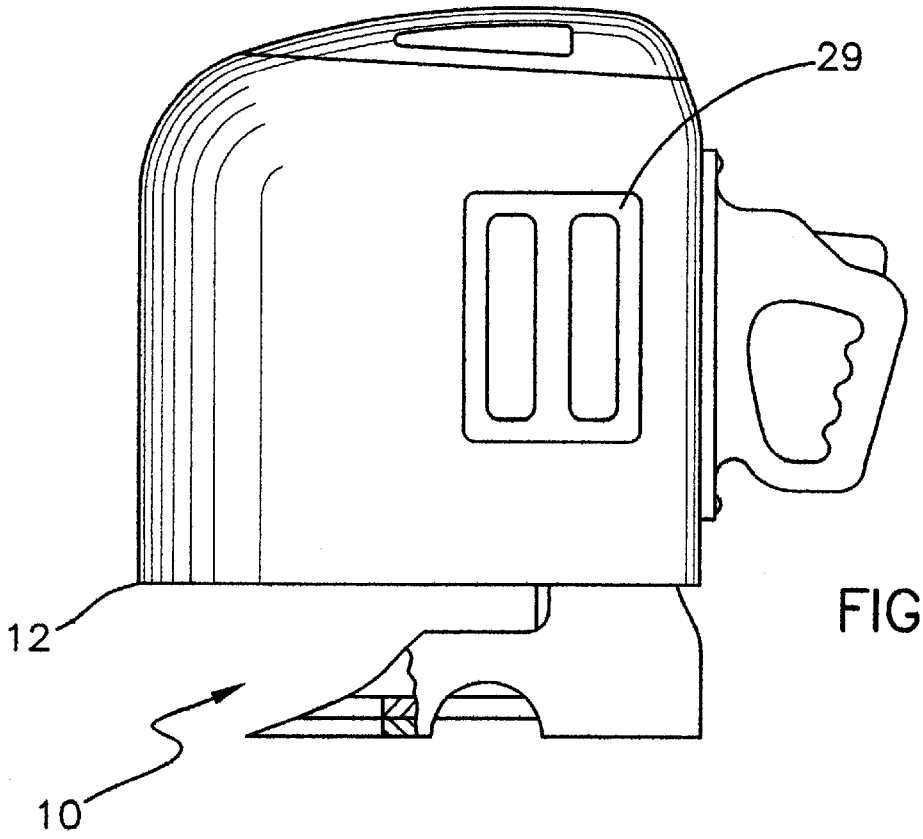
FIG. 1 is a schematic side view of a new nail removing apparatus according to the present invention.
Figure 2:
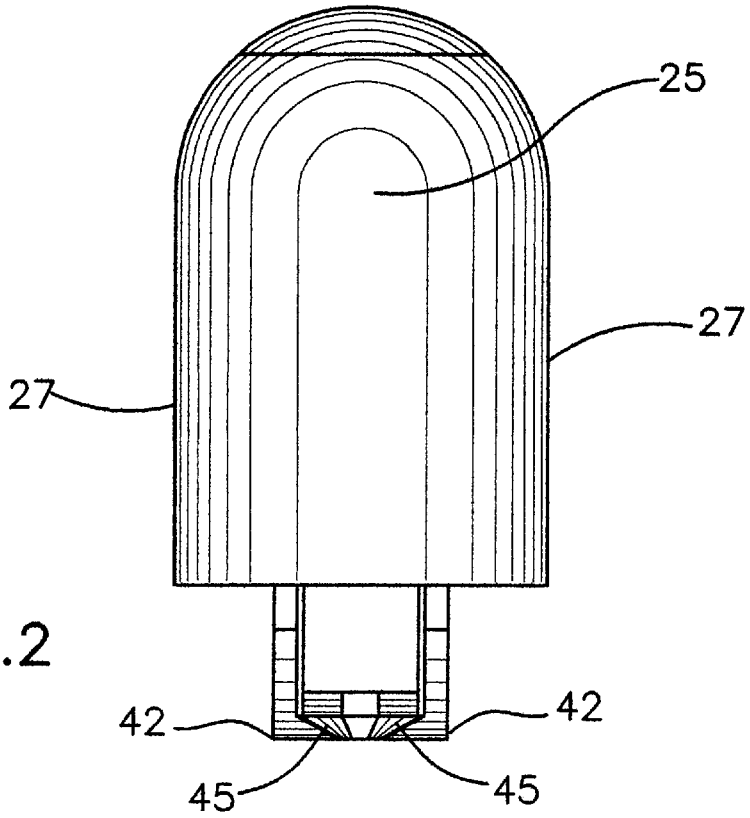
FIG. 2 is a schematic front view of the present invention.
Figure 3:
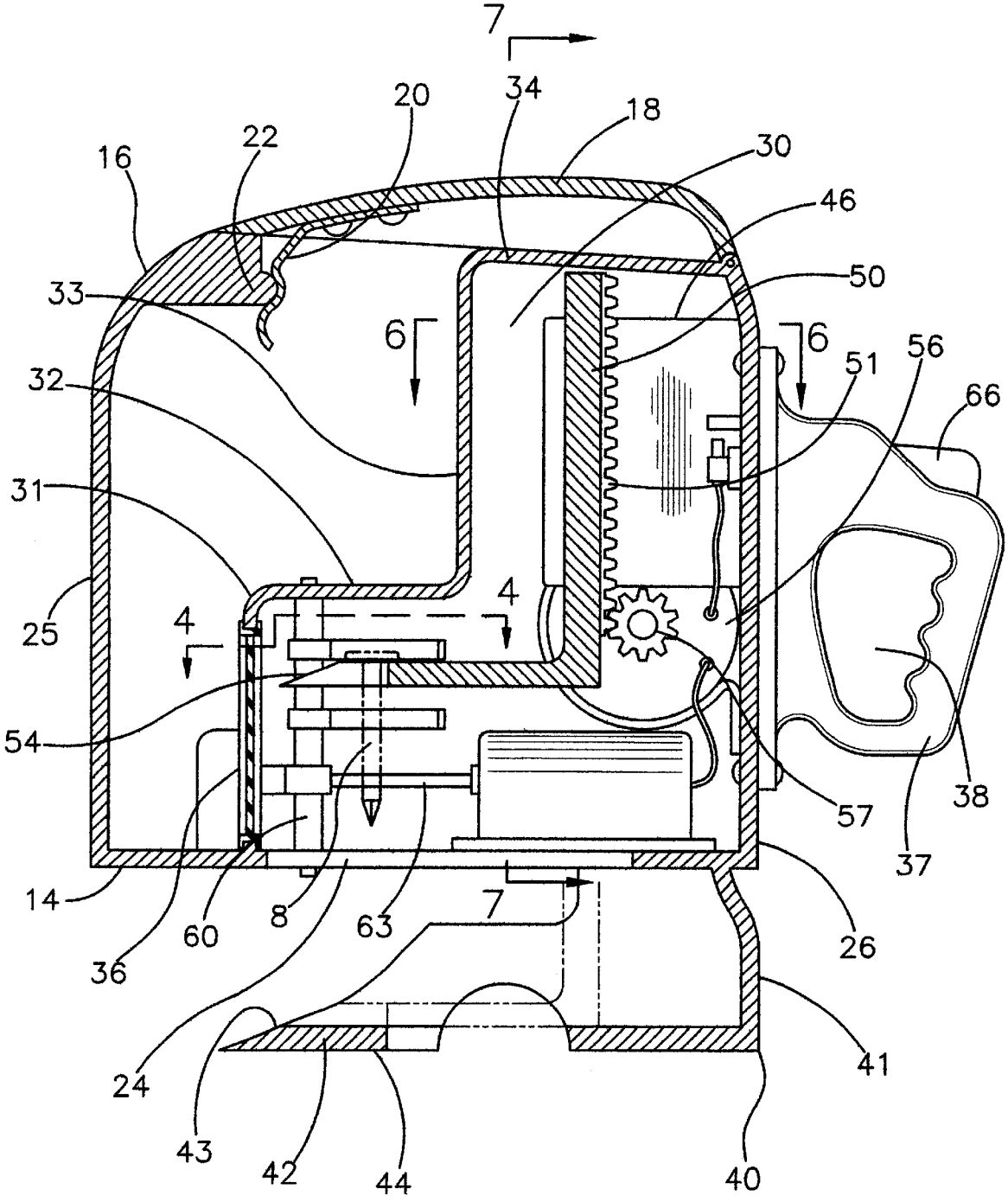
FIG. 3 is a schematic side cross-sectional view of the present invention.
Figure 4:
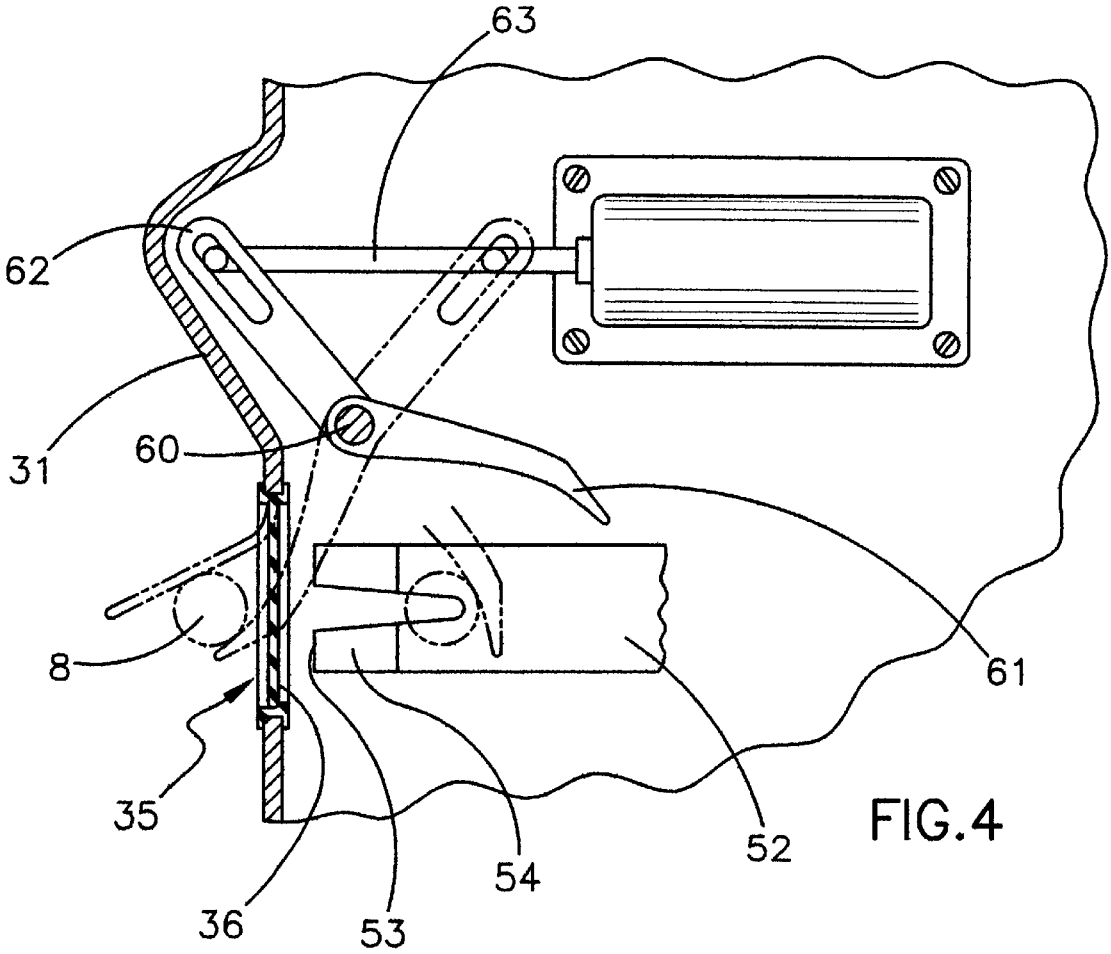
FIG. 4 is a schematic top view of the piston of the present invention.
Figure 5:
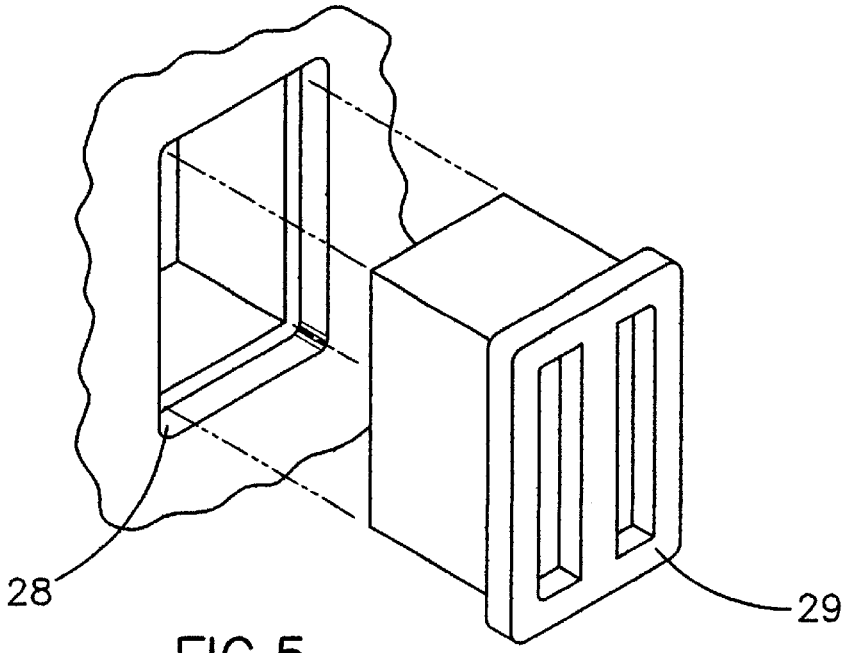
FIG. 5 is a schematic perspective view of the portal of the present invention.
Figure 6:
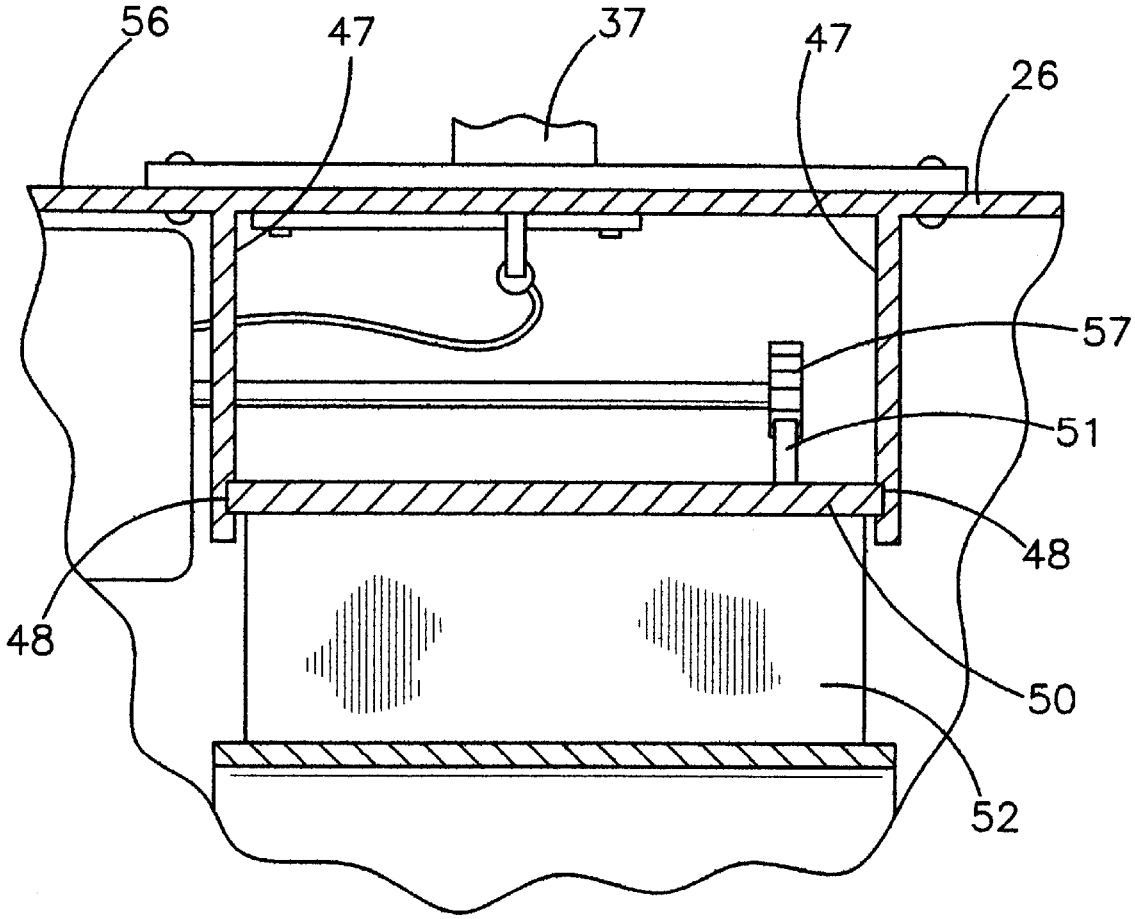
FIG. 6 is a schematic cross-sectional view taken along line 6—6 of FIG. 3 of the present invention.
Figure 7:
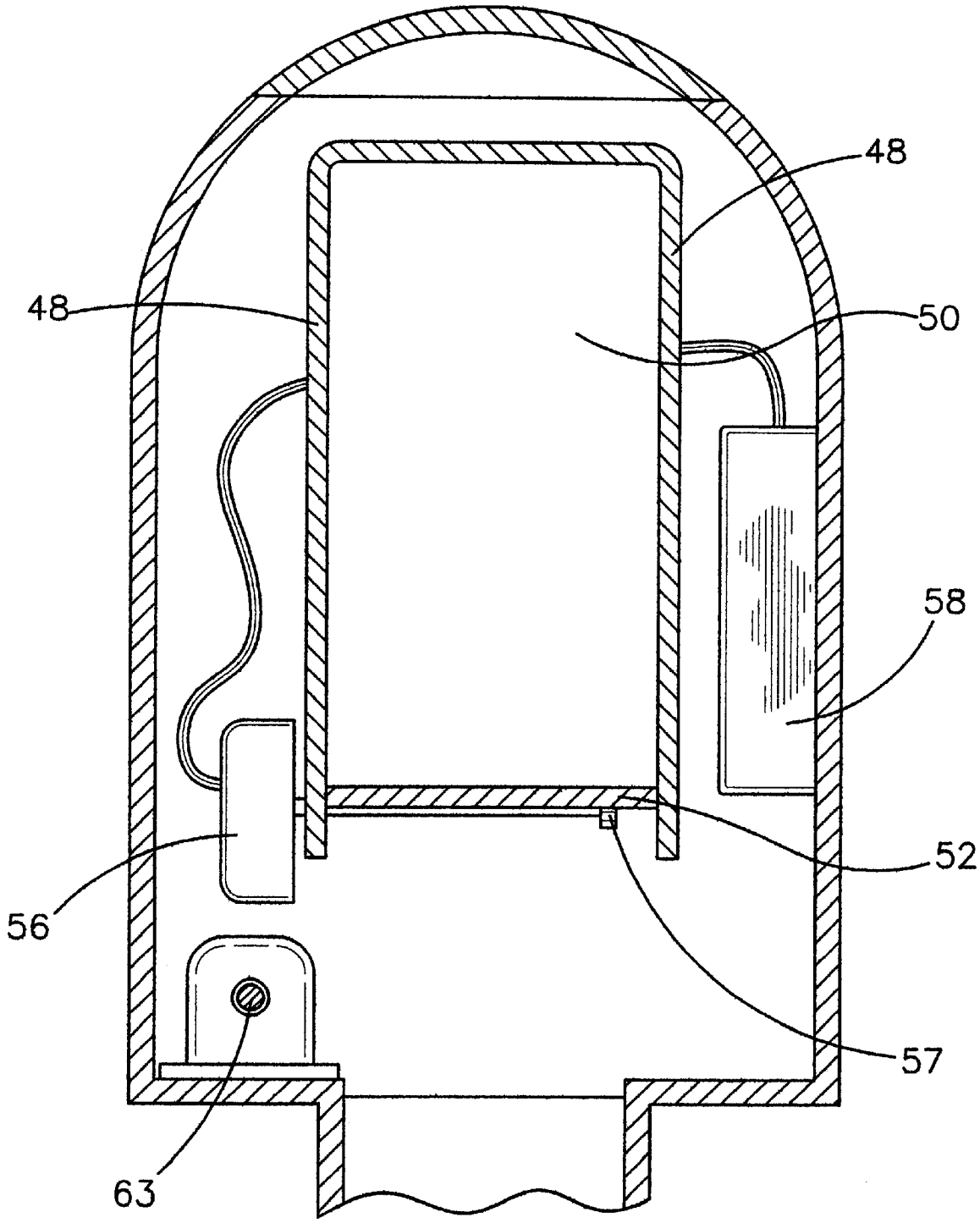
FIG. 7 is a schematic cross-sectional view taken along line 7—7 of FIG. 3 of the present invention.

With reference now to the drawings, and in particular to FIGS. 1 through 7 thereof, a new nail removing apparatus embodying the principles and concepts of the present invention and generally designated by the reference numeral 10 will be described.

As best illustrated in FIGS. 1 through 7, the nail removing apparatus 10 generally comprises a housing 12 with a bottom wall 14, a peripheral wall 16 integral to and extending upwardly from the bottom wall 14 and a top wall 18. The top wall 18 is hingedly coupled to the peripheral wall 16 and defining a door into an interior of the housing 12. The top wall 18 preferably has a bracket 20 therein for frictionally engaging a lip 22 on an inner surface of the peripheral wall 16. The bottom wall 14 has an opening 24 therein extending into the interior. The peripheral wall 16 includes a front wall 25, a back wall 26 and a pair of side walls 27. The peripheral wall 16 has a portal 28 therein and a covering 29 for removably positioning over said portal 28.

A compartment 30 is positioned in the housing 12 and includes a first vertical wall 31 extending upwardly from the bottom wall 14. The first vertical wall 31 is generally between the opening 24 and the front wall 25. The first vertical wall 31 extends to a point generally between the top wall 18 and the bottom wall 14 of the housing 12. A first horizontal wall 32 extends from a top edge of the first vertical wall 31 toward the back wall 26. A second vertical wall 33 extends upwardly from an edge of the first horizontal wall 32 upwardly to a top edge of the peripheral wall 16. A second horizontal wall 34 extends from a top edge of the second vertical wall 33 to the back wall 26. Each of the walls of the compartment 30 extends between the side walls 27 of the housing 12. The first vertical wall 31 has an aperture 35 therein extending from the bottom wall 14 to the first horizontal wall 32 and is positioned adjacent to the opening 24 in the housing 12. A flap 36 is coupled to a vertical edge of aperture 35 and generally covers the aperture 35. The flap 36 comprises a resiliently flexible material.

A handle 37 is coupled to an outer surface of the back wall 26. The handle 37 has an opening 38 therein for receiving the fingers of a user.

A foot portion 40 is integrally coupled to the bottom wall 14. The foot portion 40 has a heel 41. Each of a pair of tines 42 extends outwardly from the heel 41 in a parallel direction. Each of the tines 42 extends under the opening 24 in the housing 12. The tines 42 have an upper edge 43 tapering downward to a bottom edge 44. The tines 42 have an inside surface 45 facing each other. The inside surfaces 45 taper toward the bottom edge 44 of the tines.

A lifting apparatus lifts a nail 8 and includes a saddle 46 positioned in the compartment 30 and extends away from the back wall 26. The saddle 46 comprises a pair of rigid panels 47 orientated parallel to each other and to the side walls 27. Each of the panels 47 generally extends from a position adjacent to the top edge of the back wall 26 to a position generally between the top 18 and bottom 14 walls. Each of the panels 47 has an elongated vertical slot 48 therein extending from a top to a bottom edge of the panels 47. The slots 48 are orientated generally parallel and facing each other.

A first plate 50 is slidably mounted in the slots 48 of the saddle 46. The first plate 50 may be extended from the upper wall 34 of the compartment 30 to a position extending through the opening 24. The first plate 50 has a back side facing the back wall 26 and has a plurality of teeth 51 thereon.

A second plate 52 is integrally coupled to a bottom edge of the first plate 50 and extends toward the front wall 25 of the housing 12. The second plate 52 divides into a pair of prongs 53 as it extends away from the first plate 50. Each of the prongs 53 has an upper edge 54 tapering downward to a point such that a tapered upper edge 54 of the prongs 53 are alignable with the tapered upper edge 43 of the tines 42 when the prongs 53 are abutted against the tines 42.

A motor 56 is positioned in the housing 12 and attached to the peripheral wall 16. A gear 57 is mechanically coupled to the motor 56. The gear 57 is in communication with the teeth 51 such that rotation of the gear 57 in a first direction extends the first plate 50 through the opening 24 and rotation of the gear 57 in a second direction retracts the first plate 50 into the housing 12. A power supply 58, preferably a battery, is operationally coupled to the motor 56 and is removable through the portal 28.

An axle 60 is positioned in the compartment 30 and extends between the bottom wall 14 and the first horizontal wall 32. The axle 60 is positioned generally adjacent to the aperture 35. A fork 61 extends outwardly away from the axle 60. A rod 62 extends outwardly away from the axle 60 in a direction generally opposite of the fork 61. A piston 63 is connected to a free end of the rod 62. The fork 61 is swept across the opening 24 when the piston 63 retracts An actuator 66 selectively actuates the motor 56 for rotating the gear 57 in second first direction and releasing the actuator 66 causes the motor 56 to rotate the gear 57 in the second direction. The piston 63 retracts and then extends when the first plate 50 is fully retracted such that the fork 61 pushes a nail 8 lifted on the second plate 52 through the aperture 35. The actuator 66 is operationally coupled to the motor 56 and is mounted on the handle 37.

In use, the user presses the tines 42 under the head of a nail 8 such that the nail 8 is lifted upward from the surface in which it is embedded. The actuator 66 is pressed which causes the first 50 and second 52 plates to lower. The head of nail 8 is positioned over the prongs 53 and the actuator 66 released such that plates 50, 52 are lifted upward into the housing. When the plates 50, 52 are fully retracted, power is transferred from the motor 56 to the piston 63 and the fork 61 is swept across the opening 24 to push the nail 8 through flap 36 covering the aperture 35. The user removes the top wall 18 in order to remove the nails between the aperture 35 and the front wall 25.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A nail removing device for gripping a head of a nail and lifting the nail upwardly, said device comprising:

a housing having a bottom wall, a front wall, a back wall and a pair of side walls and a top wall, said bottom wall having an opening therein extending into said interior;

a handle being coupled to an outer surface of said back wall;

a foot portion being integrally coupled to said bottom wall, and including a pair of tines adapted for positioning under a head of the nail;

a lifting apparatus for lifting a nail comprising;

a saddle positioned in said housing;

a first plate being slidably mounted on said saddle and being extendable through said opening in said bottom wall;

a second plate being integrally coupled to a bottom edge of said first plate and having a pair of prongs thereon for lifting a nail from said foot portion; and a motor mechanically coupled to said first plate for selectively retracting and extending said first plate.

2. The nail removing device as in claim 1, wherein said top wall is hingedly coupled to a top edge of said back wall and defines a door into an interior of said housing.

3. The nail removing device as in claim 1, further including:

a compartment being positioned in said housing and generally encompassing said lifting apparatus, said compartment having an aperture thereon positioned generally adjacent to said opening; and an axle being positioned in said compartment and extending upwardly from said bottom wall, said axle being positioned generally adjacent to said aperture, a fork extending outwardly away from said axle, a rod extending outwardly away from said axle in a direction generally opposite of said fork, a piston being connected to a free end of said rod, wherein said fork is swept across said opening when said piston retracts said first plate into said compartment for moving the nail through the aperture.

4. The nail removing device as in claim 1, wherein said foot portion has a heel, each of said tines extending outwardly from said heel in a parallel direction, each of said tines extending under said opening in said housing, each of said tines having an upper edge tapering downward to a bottom edge, each of the tines having an inside surface facing each other, said inside surfaces tapering toward said bottom edge of said tines.

5. The nail removing device as in claim 4, wherein each of said prongs each has an upper edge tapering downward to a point such that a tapered upper edge of the prongs are alignable with the tapered upper edge of the tines when said prongs are abutted against said tines.

6. The nail removing device as in claim 1, wherein said saddle comprise a pair of rigid panels orientated parallel to each other and to said side walls, each of said panels generally extending from a position adjacent to said top edge of said back wall to a position generally between said top and bottom walls, each of said panels having an elongated vertical slot therein extending from a top to a bottom edge of said panels, said slots being orientated generally parallel and facing each other, said first plate being slidably mounted in said slots of said saddle.

7. The nail removing device as in claim 1, wherein said device includes:

said first plate having a back side facing said back wall having a plurality of teeth thereon;

a gear being mechanically coupled to said motor, said gear being in communication with said teeth such that rotation of said gear in a first direction extends said first plate through said opening and rotation of said gear in a second direction retracts said first plate into said housing.

8. The nail removing device as in claim 1, wherein each of said prongs each has an upper edge tapering downward to a point such that a tapered upper edge of the prongs are alignable with tapered upper edges of the tines when said prongs are abutted against said tines.

9. A nail removing device for gripping a head of a nail and lifting the nail upwardly, said device comprising:

a housing having a bottom wall, a peripheral wall integral to and extending upwardly from said bottom wall and a top wall, said top wall being hingedly coupled to said peripheral wall and defining a door into an interior of said housing, said bottom wall having an opening therein extending into said interior, said peripheral wall including a front wall, a back wall and a pair of side walls;

a compartment being positioned in said housing and including a first vertical wall extending upwardly from said bottom wall, said first vertical wall being generally between said opening and said front wall, said first vertical wall extending to a point generally between said top wall and said bottom wall of said housing, a first horizontal wall extending from a top edge of said first vertical wall toward said back wall, a second vertical wall extending upwardly from an edge of said first horizontal wall upwardly to a top edge of said peripheral wall, a second horizontal wall extending from a top edge of said second vertical wall to said back wall, each of said walls of said compartment extending between said side walls of said housing, said first vertical wall having an aperture therein extending from said bottom wall to said first horizontal wall and being positioned adjacent to said opening in said housing, a flap being coupled to a vertical edge of aperture and generally covering said aperture, said flap comprising a resiliently flexible material;

a handle being coupled to an outer surface of said back wall;

a foot portion being integrally coupled to said bottom wall, said foot portion having a heel, each of a pair of tines extending outwardly from said heel in a parallel direction, each of said tines extending under said opening in said housing, each of said tines having an upper edge tapering downward to a bottom edge, each of the tines having an inside surface facing each other, said inside surfaces tapering toward said bottom edge of said tines;

a lifting apparatus for lifting a nail comprising;

a saddle being positioned in said compartment and extending away from said back wall, said saddle comprising a pair of rigid panels orientated parallel to each other and to said side walls, each of said panels generally extending from a position adjacent to said top edge of said back wall to a position generally between said top and bottom walls, each of said panels having an elongated vertical slot therein extending from a top to a bottom edge of said panels, said slots being orientated generally parallel and facing each other;

a first plate being slidably mounted in said slots of said saddle, wherein said first plate may be extended from said upper wall of said compartment to a position extending through said opening, said first plate having a back side facing said back wall having a plurality of teeth thereon;

a second plate being integrally coupled to a bottom edge of said first plate and extending toward said front wall of said housing, said second plate dividing into a pair of prongs each having an upper edge tapering downward to a point such that a tapered upper edge of the prongs are alignable with the tapered upper edge of the tines when said prongs are abutted against said tines;

a motor being positioned in said housing and attached to said peripheral wall, a gear being mechanically coupled to said motor, said gear being in communication with said teeth such that rotation of said gear in a first direction extends said first plate through said opening and rotation of said gear in a second direction retracts said first plate into said housing;

an axle being positioned in said compartment and extending between said bottom wall and said first horizontal wall, said axle being positioned generally adjacent to said aperture, a fork extending outwardly away from said axle, a rod extending outwardly away from said axle in a direction generally opposite of said fork, a piston being connected to a free end of said rod, wherein said fork is swept across said opening when said piston retracts; and an actuator for selectively actuating said motor for rotating said gear in second first direction wherein releasing said actuator causes said motor to rotate said gear in said second direction, said piston retracting and extending when said first plate is retracted such that said fork pushes a nail lifted on said second plate through said aperture, said actuator being operationally coupled to said motor and said motor being operationally coupled to said piston, said actuator being positioned on said handle.

* * * * *